United States Patent [19]

Weiner

[11] Patent Number: 4,773,929

[45] Date of Patent: Sep. 27, 1988

[54] METHOD OF AND DEVICE FOR THE SIMULTANEOUS HEATING AND REFINING OF A METAL BATH

[75] Inventor: Antoine Weiner, Luxembourg, Luxembourg

[73] Assignee: Arbed S.A., Luxembourg, Luxembourg

[21] Appl. No.: 82,833

[22] Filed: Aug. 6, 1987

[30] Foreign Application Priority Data

Aug. 11, 1986 [LU] Luxembourg ..... 86552

[51] Int. Cl.[4] ..... C21C 7/02

[52] U.S. Cl. ..... 75/27; 75/58

[58] Field of Search ..... 75/53, 58, 27; 420/590, 420/129

[56] References Cited

U.S. PATENT DOCUMENTS

| | | | |
|---|---|---|---|
| 4,342,590 | 8/1982 | Luxckx | 75/53 |
| 4,518,422 | 5/1985 | Metz | 75/53 |
| 4,698,095 | 10/1987 | Ototani | 75/53 |

*Primary Examiner*—Peter D. Rosenberg
*Attorney, Agent, or Firm*—Herbert Dubno

[57] ABSTRACT

Heat and melt-refining reactants are simultaneously delivered to a metal melt by introducing into the melt a filled wire comprising a metal sheath and a mixture of an oxygen supplier and a metal oxygen acceptor capable of undergoing exothermic reaction to produce the melt-refining substances.

9 Claims, 1 Drawing Sheet

METHOD OF AND DEVICE FOR THE SIMULTANEOUS HEATING AND REFINING OF A METAL BATH

FIELD OF THE INVENTION

My present invention relates to a method of refining and heating a metal melt and, more particularly, to the refining and heating of a steel melt by the introduction into the latter, below the surface thereof, of a material which is capable of effecting a chemical reaction with the metal of the melt in a refining or purifying action.

BACKGROUND OF THE INVENTION

While melt refining or purification can be effected in a variety of ways, it is known to refine or purify a metal bath, e.g. of steel, by the introduction into the melt of specific solids, including calcium or calcium compounds, ferrosilicon, Perrin slags, and other aluminum-containing compositions, soda and the like. Since these materials must be mixed with the bath, the most common form of introduction was injection in an inert gas. During the reaction process, these approaches have generally led to temperature losses which had to be tolerated or compensated by heating independently of the supply of the purifying reactants to the melt.

Another problem also characterized earlier systems for the purifying of a metal bath utilizing such materials. Generally the bath is overlain by a slag which can interfere with the introduction of the materials into the melt. The removal of the slag is time consuming and requires special apparatus at high capital cost. Even with earlier efforts to remove the slags, it was not always possible to completely eliminate the slag layer.

The problem of the presence of a slag on top of the melt was largely circumvented by a process as described in German Pat. No. 22 53 630. In that process, a portion of the bath was so confined that it possessed a slag-free upper surface zone through which the refining materials could be introduced into contact with the melt.

This confinement was effected by a pipe which was lowered vertically into the melt and had at its lower end a cap which prevented entry of slag into the pipe but was destroyed at the higher melt temperatures after the lower end bearing the cap was below the slag layer. The slag-free volume of the melt within the pipe could be treated with metallurgically effective materials of the type described and the homogenization of the portion with the pipe with the remainder of the bath was effected by introducing an inert gas stream from below into the pipe.

U.S. Pat. No. 3,971,655 describes a similar process as well as a number of variations on the devices used. The pipe element which is employed is so constructed that above the slag-free zone, a nonoxidizing atmosphere can be maintained.

The problem described above has also been attacked by an approach as described in U.S. Pat. No. 4,518,422 which charges a limited bath volume with the refining substances concurrently with the introduction of oxygen in a gaseous form so that an exothermic reaction with the oxygen can be generated to liberate heat to the melt and give rise to reactive slags such as the aluminum-based Perrin slag. To ensure that the heat is effectively delivered to the bath, the latter must be mixed and this is done by means of an inert gas stream which, in its turn, has a cooling function. A certain amount of the heat is also lost to the bath through the pipe wall.

OBJECTS OF THE INVENTION

It is the principal object of the present invention to provide a method of treating a metal bath with refining substances which simultaneously can serve to heat the bath and in addition avoid the drawbacks of earlier systems.

Another object of the invention is to provide a method of simultaneously heating and refining a steel melt whereby the heating effect can insure a maximum delivery of heat to the melt.

Still another object of this invention is to provide an improved device for simultaneously refining and heating a metal, e.g. steel bath or melt.

SUMMARY OF THE INVENTION

These objects and others which will become apparent hereinafter are attained, in accordance with the present invention, by heating the melt with a metallothermic reaction by introducing into the melt and below the upper surface thereof, a metal wire which comprises a metal sheath and is filled with a filling which comprises a mixture of a metallic oxygen acceptor and an oxygen-supplying compound, the metallic oxygen acceptor and this compound reacting below the surface of the melt by liberation of oxygen from the compound and exothermic oxidation of the metallic acceptor, to generate heat and thereby heat the melt, while simultaneously liberating at least one substance capable of reacting with the melt in a refining or purifying type of reaction.

The mixture, which is stable at ambient temperatures which are substantially below the temperature within the body of the melt, can be activated by the high temperatures of the latter, to provide the exothermic reaction described and the liberation of compounds which are reactive with the melt in the refining action.

Advantageously, the sheath of the wire can be composed of steel or aluminum, the metallic oxygen acceptor is pulverulent or granulated aluminum, silicon, ferrosilicon, calcium, calcium-silicon or magnesium. The oxygen supplier can be an oxide of iron, calcium, magnesium, manganese, sodium or potassium and/or a peroxide of calcium, magnesium, sodium or potassium.

The use of a filled wire which comprises a steel sheath and a filling for calcium plus silicon plus lime or of magnesium plus calcium fluoride or of ferrosilicon, has been known for some time in conjunction with metallurgical processes carried out in the ladle. Here, however, the main purpose of the filled wire is the simplicity of metering the additive to the melt because one need only use a certain length of the wire for that purpose.

By contrast, the invention provides for the generation of an exothermic reaction deep in the bath with the simultaneous form of reaction products which can react with the bath in the refining action so that these substances are added without regard for any effect of a slag covering and thus without the need for special expedients here to exclude the slag from a zone of the surface which, of necessity, requires a comparatively intense inert gas flow to distribute the reaction over the body of the melt.

While in principle practically any oxygen supplier can be used which can be activated to undergo exothermic reaction at the temperatures in the melt, it has been found to be advantageous to use oxides such as $Fe_2O_3$ in conjunction with aluminum as a metallic oxygen acceptor so that the aluminum functions as a reducing agent for the oxide.

Peroxides such as calcium peroxide can also be used with advantage since these split off oxygen relatively easily, e.g. at temperatures as low as 290° C.

The reaction $2Al+3CaO_2=Al_2O_3+3CaO$ not only is highly exothermic and liberates a considerable amount of heat to the melt, but also provides reaction products which have melt purifying or refining properties. These are readily dispersed in the bath. One can imagine that it might be possible to do the same thing by injecting a mixture of the metal powder and oxygen supplier by immersion lances or bottom-blowing nozzles. However, because of the high exothermicity of the reaction, the bottom-blowing nozzles and immersion lances would be rapidly destroyed or damaged, thereby making the process uneconomical. The use of a filled wire with a steel sheath eliminates this drawback entirely and allows the reaction to occur only well below the melt surface.

When the sheath is composed of aluminum, the reaction may occur at an earlier point but by rapidly thrusting the wire below the surface of the melt, this danger can be reduced.

It is possible to delay the reaction somewhat by diluting the mixture with lime or a mixture of lime and fluorspar. This dilution also has the function of limiting the formation of inclusions or to reduce the tendency toward the formation of detrimental inclusions since the products rise rapidly to the surface of the melt. To induce this rising effect, I can employ the bottom blowing with inert gas at a comparatively low rate, for example 0.05 to 0.1 $m^3/t$ (STP) . minute.

In principle, any kind of filled-wire structure can be used for carrying out the invention although, obviously, one cannot employ a filled-wire construction which requires a welding seam after the filling has been emplaced because then the welding action may activate the filling. A welded seam wire can be used if the filling is supplied later or one can employ a seamless sheath wire construction.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
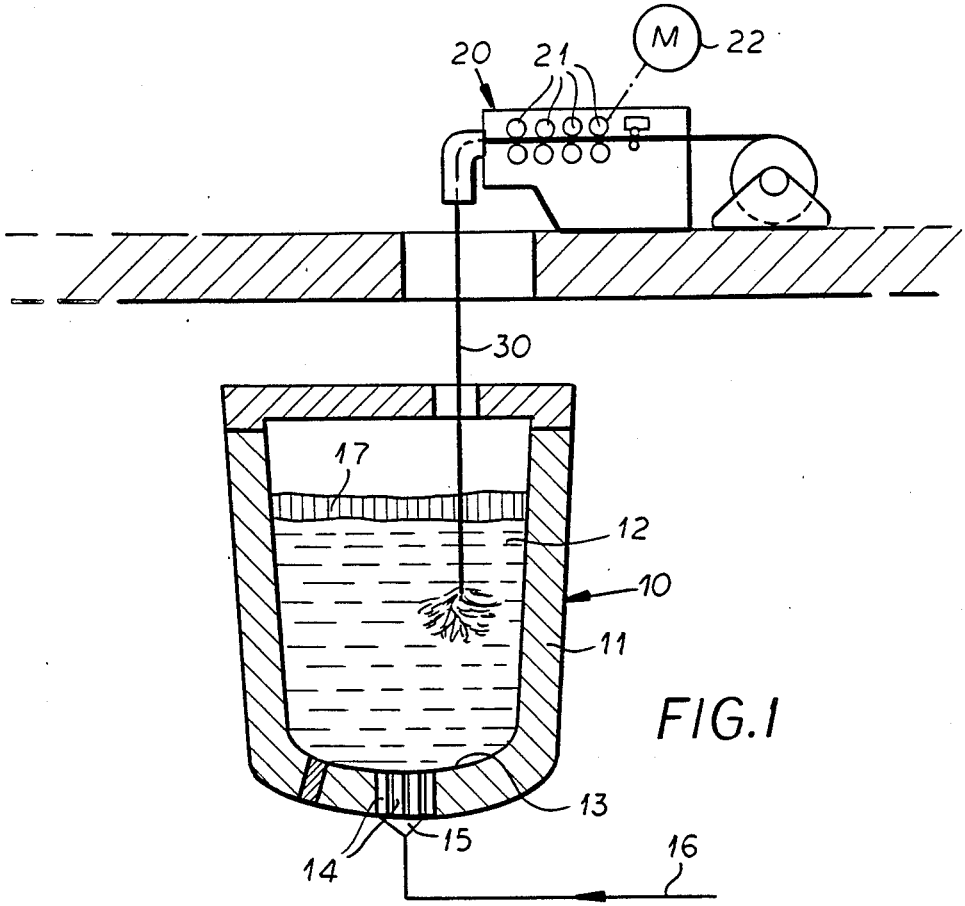
FIG. 1 is a diagrammatical vertical section of an apparatus for carrying out the invention.

In the draWing I have shown a ladle 10 which may be lined at 11 with a refractory and contains a steel melt 12 to be treated in accordance with the invention. The floor 13 of the ladle may have a bottom-blowing porous element 14 which is supplied with an inert gas, such as argon, from a plenum 15, the argon being supplied by a pipe 16.

Above the ladle, means 20 can be provided for feeding a filled wire 30 through the upper surface 17, which may be covered by slag, of the melt. This device 20 is shown to include feed rollers 21 driven by a motor 22 and drawing the filled wire from a reel (not shown) thereof.

Figure 2:
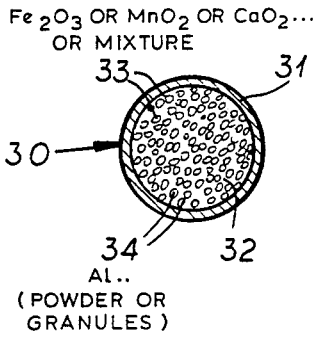
FIG. 2 is a transverse section of the wire, greatly enlarged over the illustration in FIG. 1.

As can be seen from FIG. 2, the filled wire comprises a metal sheath 31, which can be in the form of a seamless tube which is filled with a mixture 32 of an oxygen supplier 33, such as calcium peroxide, and aluminum particles 34 or some other metallic oxygen acceptor.

At the temperature within the body of the melt, the steel tube is destroyed and merges with the melt while within the tube the exothermic reaction which produces the melt-refining reactants is carried out.

SPECIFIC EXAMPLE

Two cored Wires of identical composition were fed simultaneously and at the same speed into a ladle containing 138 metric tons of an aluminum-calmed steel bath (the steel quality was compared to US ASTM 570 Grade 50). The cover of the ladle was provided with 2 holes for the insertion of the cored wire. The analysis of the cored wire was 25.07 weight-% aluminum and 74.93 weight-% $Fe_2O_3$, the latter containing 2% of gangue. The iron-sheathed cored wire had an outer diameter of 13 mm.

A total length of 5,000 meters of this wire was introduced over 15 minutes.

Before placing the cover on the ladle and the start of introduction of the cored wire, 34 kg of fluorspar as fluxing agent and 500 kg of calcium oxide were added on the surface of the bath. The addition of calcium oxide was intended to combine the alumina formed by the oxidation of the aluminum in the form of a Perrin-like desulphurizing slag.

After this addition and after deposing the cover on the ladle, the bath temperature amounted to 1,577° C. and the bath oxygen content to 30.3 ppm. During the introduction of the cored wire, the bath was stirred by argon, introduced through porous bottom bricks at a rate of 2 $Nm_3$ per hour.

In the course of the introduction of the cored wire during 15 minutes, the bath temperature could be held at 1,576° C. Taking into account a normal temperature loss in an untreated and calm bath of 1° C. per minute, it can be stated that the introduction of the cored wire led to a real rise in temperature.

At the end of the treatment by cored Wire, the oxygen content of the bath had decreased to 1.6 ppm.

Besides the lowering of the free oxygen content, the introduction of the cored wire and the combined injection of bottom-blown argon produced a stirring of the Perrin-like slag with the steel bath, thus having a positive effect on the inclusions in the bath.

At the end of the treatment by cored wire, Fe-Si, Fe-Nb and Fe-Mn were added in order to adjust the analysis of the steel to the required values. The final steel was tapped at a temperature of 1,560° C.

The thermal yield of the aluminum contained in the wire was established at 82.9%.

The desired final steel analysis, as well as the analyses after wire introduction and after corrective final additions are given in the following table:

| | % by weight | | | | | | |
|---|---|---|---|---|---|---|---|
| | C | Mn | P | S | Si | Al | Nb |
| Desired final Analysis | 0.140 | 1.37 | 0.020 (max) | 0.015 (max) | 0.250 | 0.040 | 0.030 |
| Analysis at start of wire introduction | 0.141 | 1.32 | 0.016 | 0.010 | 0.233 | 0.009 | 0.028 |
| Analysis after wire | 0.164 | 1.37 | 0.017 | 0.010 | 0.236 | 0.055 | 0.041 |

-continued

| | % by weight | | | | | | |
|---|---|---|---|---|---|---|---|
| | C | Mn | P | S | Si | Al | Nb |
| introduction and corrective additions | | | | | | | |

I claim:

1. A method of simultaneously heating and refining a metal melt, comprising the steps of:

(a) providing a bath of said melt in a vessel so that said bath has a melt upper surface;

(b) continuously introducing below said surface of said melt a filled wire comprising a metal sheath, and, as a filling within said sheath, a mixture of at least one comminuted metallic oxygen acceptor and at least one comminuted compound forming an oxygen supplier;

(c) inducing reaction of said compound below said surface of said melt to release oxygen and exothermic reaction of the oxygen thus released with said metallic oxygen acceptor to heat said melt while forming from said mixture upon said reactions at least one substance which reacts with said melt in a melt-refining action; and (d) controlling a rate at which said filled wire is continuously fed to maintain a predetermined temperature of said bath.

2. The method defined in claim 1 wherein said metal sheath is composed of steel.

3. The method defined in claim 1 wherein said metal sheath is composed of aluminum.

4. The method defined in claim 2 or claim 3 wherein said metallic oxygen acceptor is selected from the group which consists of aluminum, silicon, ferrosilicon, calcium, calcium-silicon or magnesium in pulverulent or granular form.

5. The method defined in claim 4 wherein said compound forming said oxygen supplier is selected from the group which consists of oxides of iron, calcium, magnesium, manganese, chromium, nickel, boron, sodium and potassium.

6. The method defined in claim 4 wherein said compound forming said oxygen supplier is selected from the group which consists of peroxides of calcium, magnesium, sodium and potassium.

7. The method defined in claim 2 or claim 3 wherein said mixture is diluted with lime or lime and fluorspar.

8. A method of simultaneously heating and refining a metal melt, comprising the steps of:

providing a bath of the melt in a vessel so that said bath has a melt upper surface;

continuously introducing below said surface of said melt a filled wire comprising a metal sheath, and, as a filling within said sheath, a mixture of aluminum particles and calcium oxide particles and iron oxide particles;

inducing an exothermic reaction of said iron oxide particles and calcium oxide particles with said aluminum particles below said surface to form a product which further reacts with said melt in a melt-refining action; and controlling a rate at which said wire is continuously fed to maintain a predetermined temperature of said bath.

9. A device for simultaneously heating and refining a metal melt, comprising:

means forming a vessel for a steel melt, said steel melt partially filled said vessel has an upper surface;

a filled wire inserted into said melt for metallothermic reaction, said wire comprising a sheath, and as a filling within said sheath aluminum particles and iron oxide and calcium oxide particles, so that said aluminum particles and said iron oxide particles react exothermically below said surface of said melt, while simultaneously liberating a product capable of reacting with the melt in a melt-refining action;

means for continuous feeding said wire into said melt; and means for controlling a rate at which said wire is fed into said melt to maintain a predetermined temperature.

* * * * *